US007189937B2

(12) United States Patent
Chen

(10) Patent No.: US 7,189,937 B2
(45) Date of Patent: Mar. 13, 2007

(54) BUTTON STRUCTURE

(75) Inventor: Chiu-Chia Chen, Peitou (TW)

(73) Assignee: ASUSTek Computer Inc., Taipei (TW)

( * ) Notice: Subject to any disclaimer, the term of this patent is extended or adjusted under 35 U.S.C. 154(b) by 0 days.

(21) Appl. No.: 11/403,816

(22) Filed: Apr. 14, 2006

(65) Prior Publication Data

US 2006/0243578 A1 Nov. 2, 2006

(30) Foreign Application Priority Data

Apr. 29, 2005 (TW) ..... 94114011 A

(51) Int. Cl.
*H01H 3/12* (2006.01)

(52) U.S. Cl. ..... 200/343

(58) Field of Classification Search ..... 200/5 A, 200/517, 341–345; 341/22; 345/168, 169; 400/490–496

See application file for complete search history.

(56) References Cited

U.S. PATENT DOCUMENTS

| | | | | |
|---|---|---|---|---|
| 4,914,999 | A * | 4/1990 | Masubuchi et al. | 84/423 R |
| 5,481,074 | A * | 1/1996 | English | 200/5 A |
| 6,633,011 | B2 * | 10/2003 | Ogawa et al. | 200/343 |
| 6,914,206 | B2 * | 7/2005 | Mukougawa | 200/556 |
| 6,964,532 | B1 * | 11/2005 | Lu | 400/490 |

* cited by examiner

*Primary Examiner*—Michael A. Friedhofer
(74) *Attorney, Agent, or Firm*—Birch, Stewart, Kolasch & Birch, LLP

(57) ABSTRACT

A button structure includes a cantilever connected with a housing and a key connected with the cantilever. This cantilever includes two connection parts and a curved part. The two connection parts are coupled together through the curved part. One connection part is connected to a housing. The other connection part is connected to a key.

6 Claims, 7 Drawing Sheets

BUTTON STRUCTURE

RELATED APPLICATIONS

The present application is based on, and claims priority from, Taiwan Application Serial Number 94114011, filed Apr. 29, 2005, the disclosure of which is hereby incorporated by reference herein in its entirety.

FIELD OF THE INVENTION

The present invention relates to a button structure, and more particularly, a button structure with a imoproved cantilever.

BACKGROUND OF THE INVENTION

Today, a trend for commercial electronic devices is to integrate more and more functionality therein to attract consumers. To operate these electronic devices, more and more buttons are thus required.

FIG. 1 illustrates the typical button structure including a key 100, an elastomer 102 and a trigger 104. When a user pushes the key 100, the elastomer 102 is deformed to force the trigger 104 down to touch a film switch formed on the printed circuit board 106 to trigger a special circuit for realizing a special functionality. Typically, the elastomer 102 is a spring. However, an additional elastomer 102 is required in this typical button structure. Therefore, such a structure does not offer optimum integration.

To overcome the foregoing drawback, a cantilever is typically used to replace the elastomer. FIG. 2 illustrates this improved button structure. A cantilever 202 is connected to the housing 200. A key 204 is connected to the cantilever 202. When a user pushes the key 204, the cantilever 202 is bent to force the key 204 down to touch a film switch formed under the key 204. Then, a recovery force provided by the cantilever 204 causes the key 204 to return to its original position. Although the improved button structure offers better integration, the elasticity is related to the length of the cantilever 202. When a larger elasticity is required, the cantilever 204 has to be lengthened. Such a structure renders the cantilever 204 to be easily broken. Moreover, a hole formed in the housing 200 is necessary for forming the cantilever 204. A bigger hole is required for forming a longer cantilever 204 to provide a larger elasticity, which often uglifies the overall appearance.

Therefore, an integrated button structure is required.

SUMMARY OF THE INVENTION

Therefore, it is the main purpose of the present invention to provide an integrated button structure.

Another purpose of the present invention is to provide a button structure with a shortened cantilever.

Yet a further purpose of the present invention is to provide a button structure with an enhanced cantilever.

Accordingly, the present invention provides a button structure with an cantilever. This cantilever includes two connection parts and a curved part. The two connection parts are coupled together through the curved part. One connection part is connected to a housing. The other connection part is connected to a key.

The present invention also provides the aforementioned button structure with an cantilever, wherein sRibs are respectively used in the two connection parts where they are connected to the curved part to enhance the mechanical strength.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the following detailed description and the accompanying drawings, which are given by way of illustration only, and thus are not limitative of the present invention, and wherein.

DETAILED DESCRIPTION OF THE PREFERRED EMBODIMENTS

Figure 1:
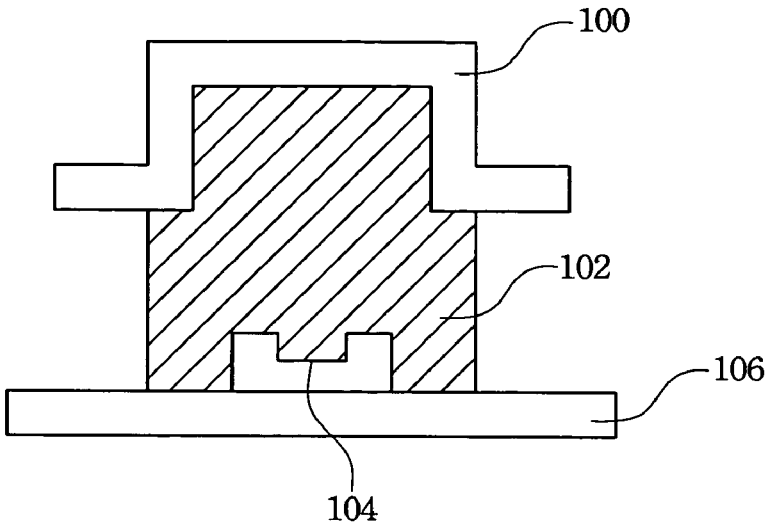
Fig. 1 (PRIOR ART)
FIG. 1 illustrates a schematic diagram of a typical button structure.
Figure 2:
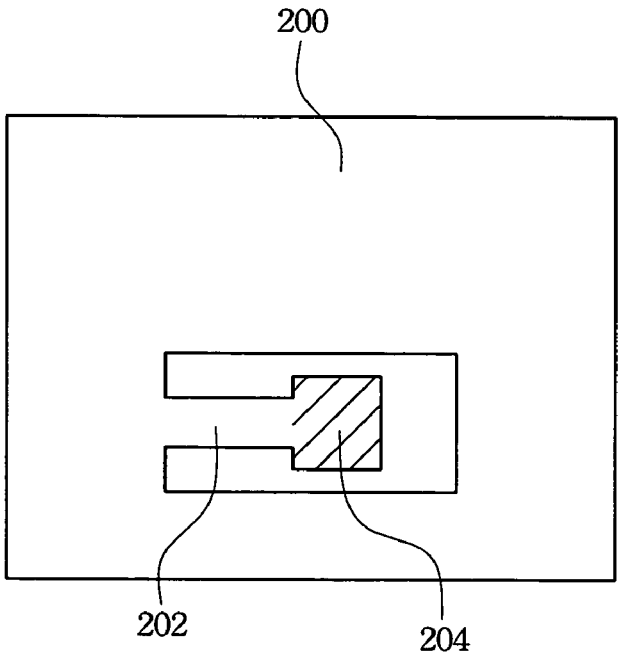
Fig. 2 (PRIOR ART)
FIG. 2 illustrates a schematic diagram of a typical button structure with an cantilever.
Figure 3A:
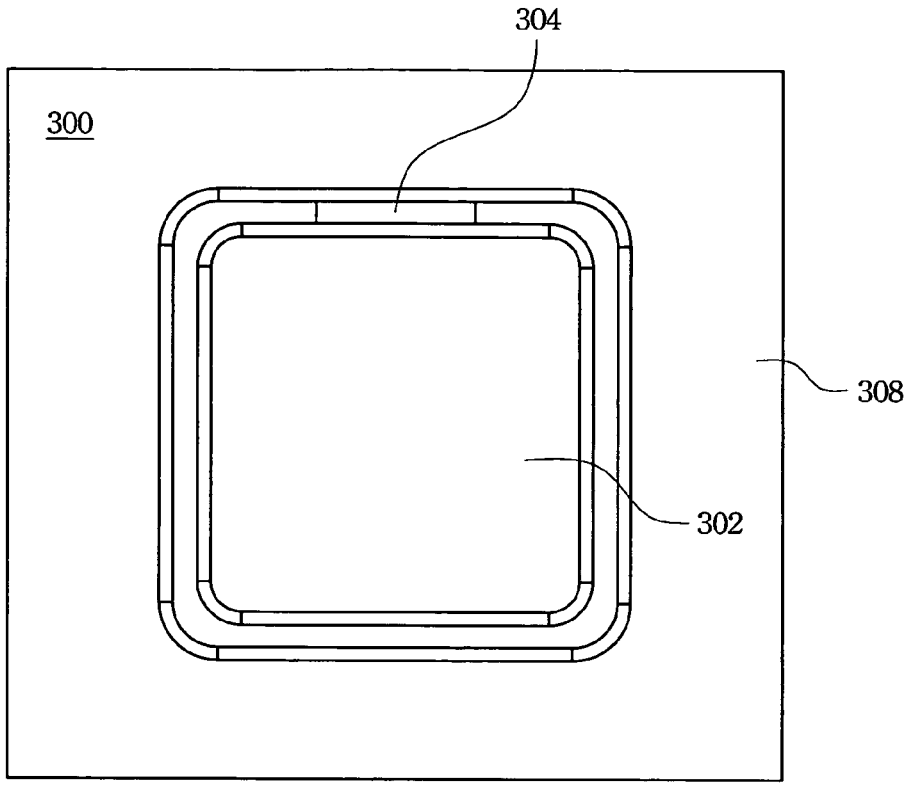
FIGS. 3A to 3C illustrate schematic diagrams of a button structure according to the preferred embodiment of the present invention.

FIG. 3A is a front view of a housing with a button structure according to the preferred embodiment the present invention. This button structure 300 has an independent cantilever 304, shown in FIG. 3B, extending from the housing 308. The key 302 is coupled to the housing 308 through the cantilever 304. The cantilever 304 is integrated into the housing 308. In other words, the cantilever 304 and the housing 308 are formed and connected together.

Figure 3B:
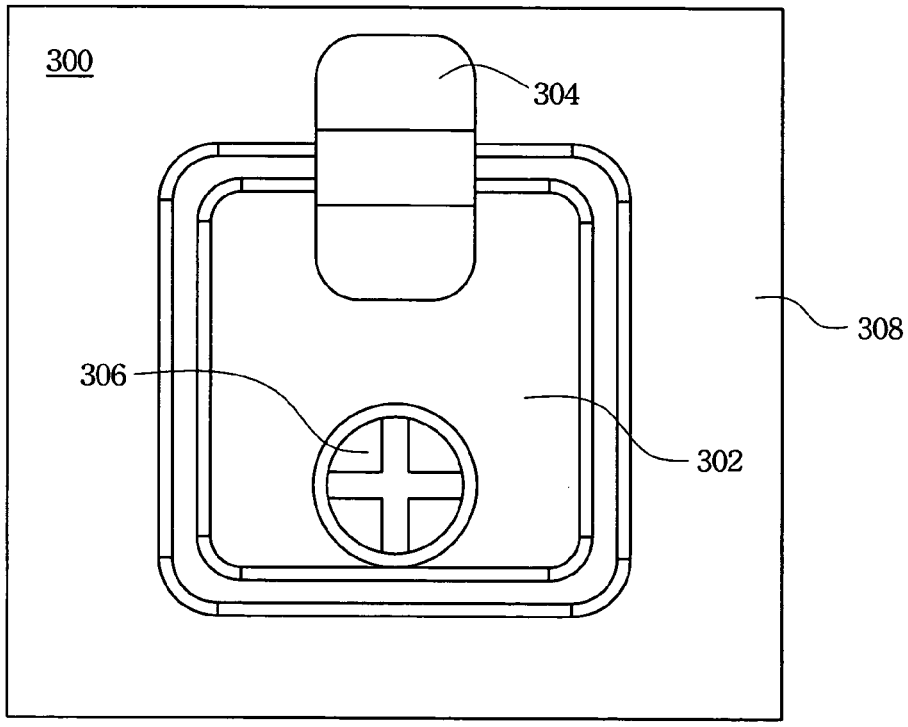

FIG. 3B is a back view of the housing with a button structure according to the present invention. The key 302 is coupled to the housing 308 through the cantilever 304. A trigger 306 is formed over the key 302. The trigger 306 is used to bridge a circuit in a printed circuit boart (not shown in this figure).

Figure 3C:
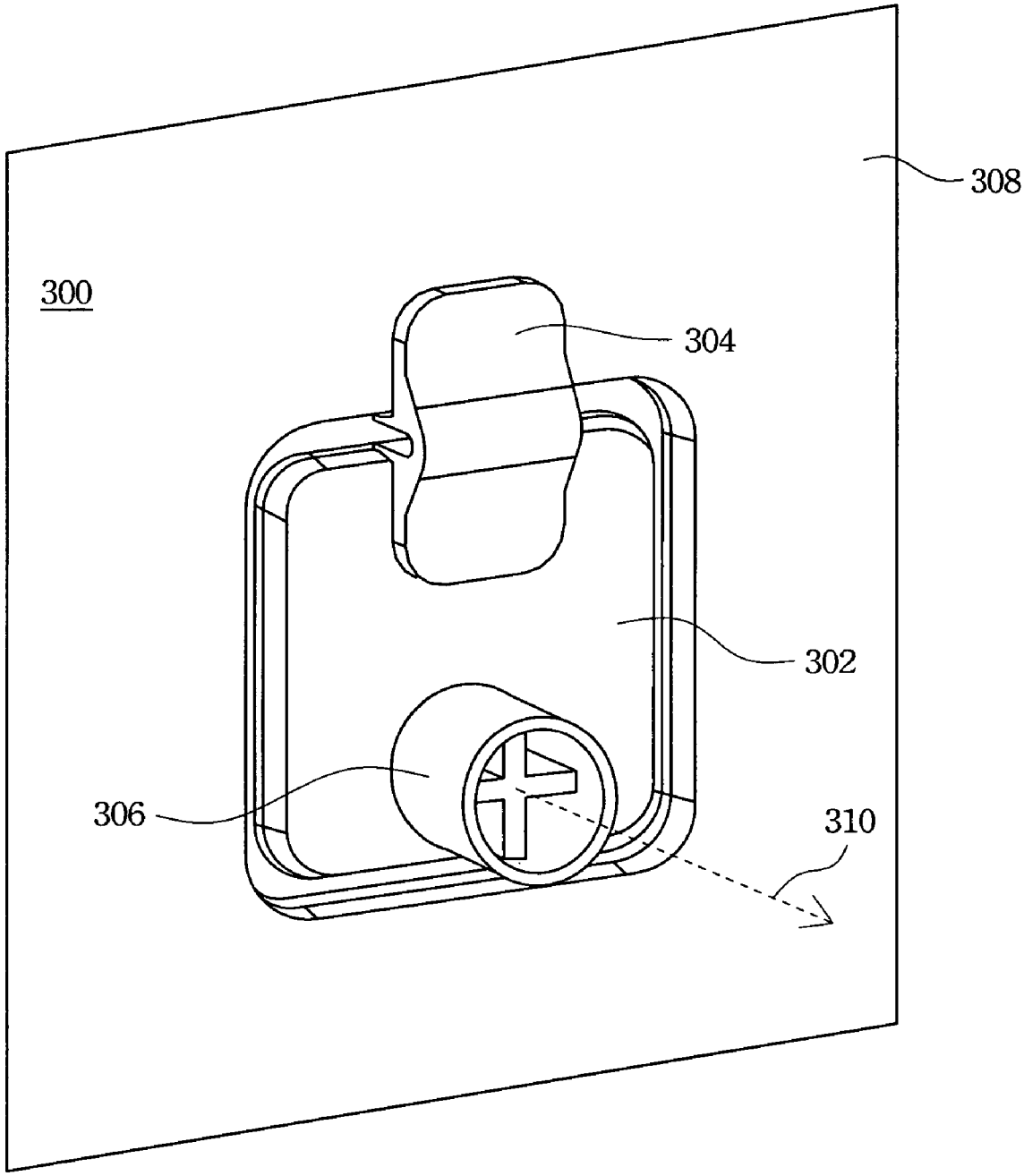

FIG. 3C is a side view of the housing shown in FIG. 3B. The key 302 is coupled to the housing 308 through the cantilever 304. A curved part is formed in the cantilever 304 to shorten the cantilever. A trigger 306 is formed on and protrudesledge from the key 302. When a user pushes the key 302, the cantilever 304 is deformed to move the trigger 306 in the direction of the arrow 310 to bridge a corresponding circuit (not shown in this figure) to perform a special function. The cantilever 304 has a curved part. Therefore, the length of the cantilever 304 can be shortened. The key 302 is also positioned closer to the housing 308.

Figure 4A:
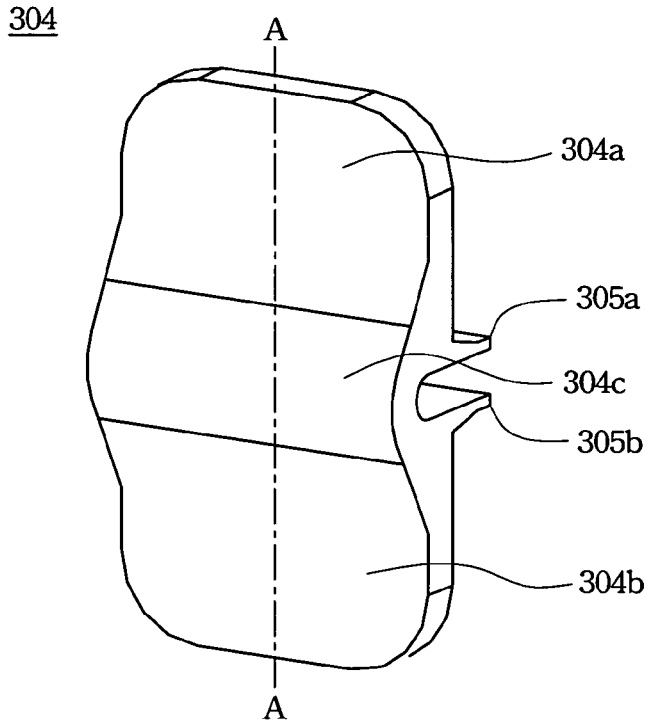
FIGS. 4A to 4C illustrate schematic diagrams of an cantilever according to the preferred embodiment of the present invention.

FIG. 4A is a three-dimensional diagram of the cantilever according to embobiment of the present invention. Referring to FIG. 3B and FIG. 4A, the cantilever 304 includes two connection parts 304*a* and 304*b* and a curved part 304*c*. According to the preferred embodiment, the appearance of the curved part 304*c* is a semicircle. The two connection parts 304*a* and 304*b* are coupled together through the curved part 304*c*.

Figure 4B:
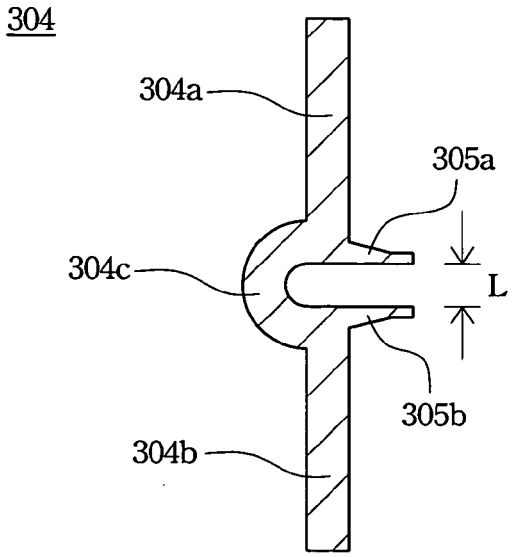

FIG. 4B is a cross-sectional view along the A—A line of FIG. 4A. The connection part 304*a* is connected to the housing 308. The connection part 304*b* is connected to the key 302. The ledges 305*a*, 305*b* extend outward from the curved part 304*c*. The ledges 305*a*, 305*b* are used as stoppers for respectively stopping the housing 308 and the key 302. In other words, when the cantilever 304 is used to connect the housing 308 and the key 302, the distance L between the ledges 305*a*, 305*b* is the distance between the housing 308 and the key 302. According to the preferred embodiment, the distance L is about 0.3 mm to 1.2 mm. The radius of the curved part 304*c* is about 0.3 mm to 0.6 mm. It is noticed that the distance and the radius are changeable to fit various embodiments. Since the cantilever 304 has a curved part, the length of the cantilever 304 can be shortened to make the key 302 closer to the housing 308.

Figure 4C:
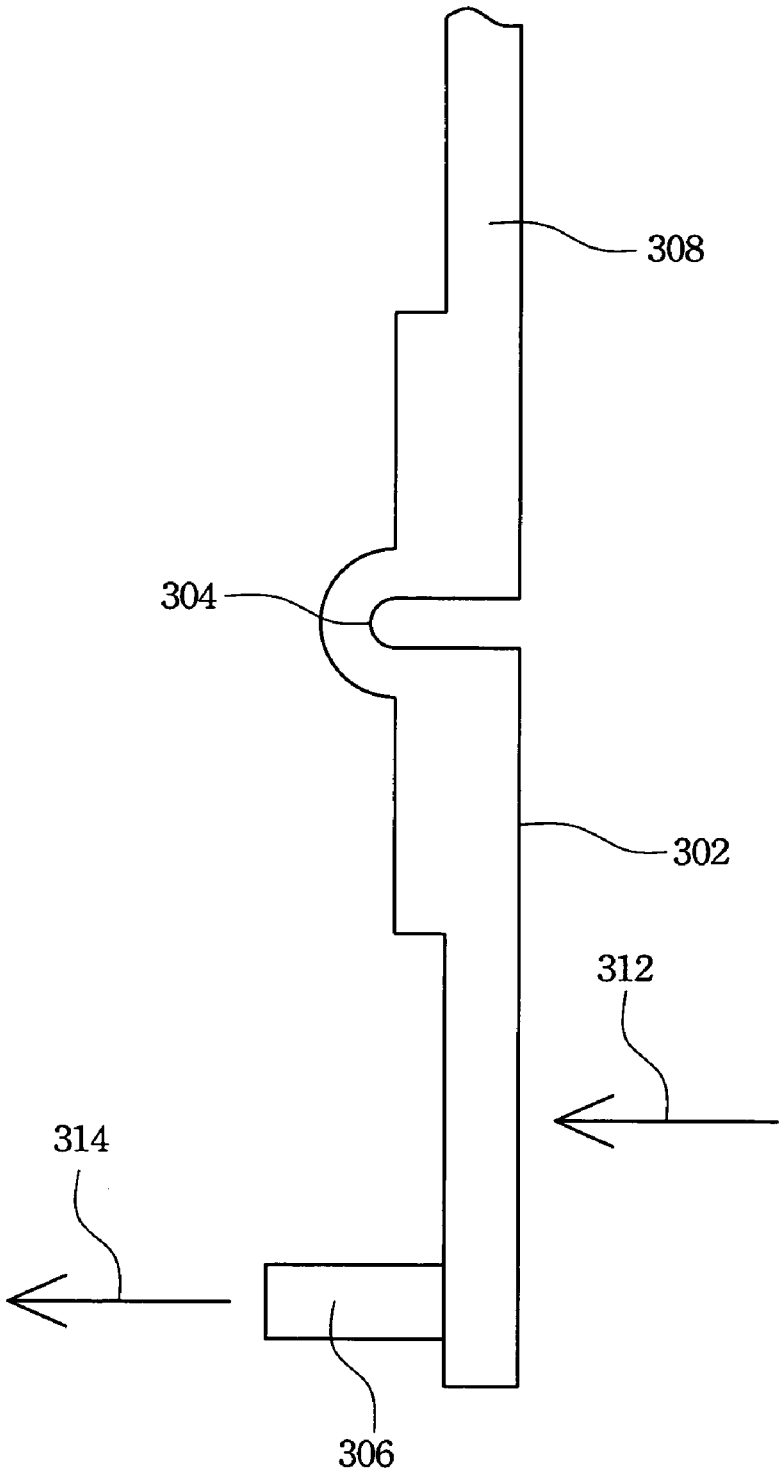

FIG. 4C is a side view of the cantilever connecting the housing and the key. The connection part 304*a* is connected to the housing 308. The connection part 304*b* is connected to the key 302. When a push force is applied to the key 302 in the direction of the arrow 312, the cantilever 304 is deformed in the direction of the arrow 314, moving the trigger 306 to bridge a corresponding circuit (not shown in this figure) to perform a special function. The cantilever 304 is integrated into the housing 308. In other words, the cantilever 304 and the housing 308 are formed and connected together.

Figure 5A:
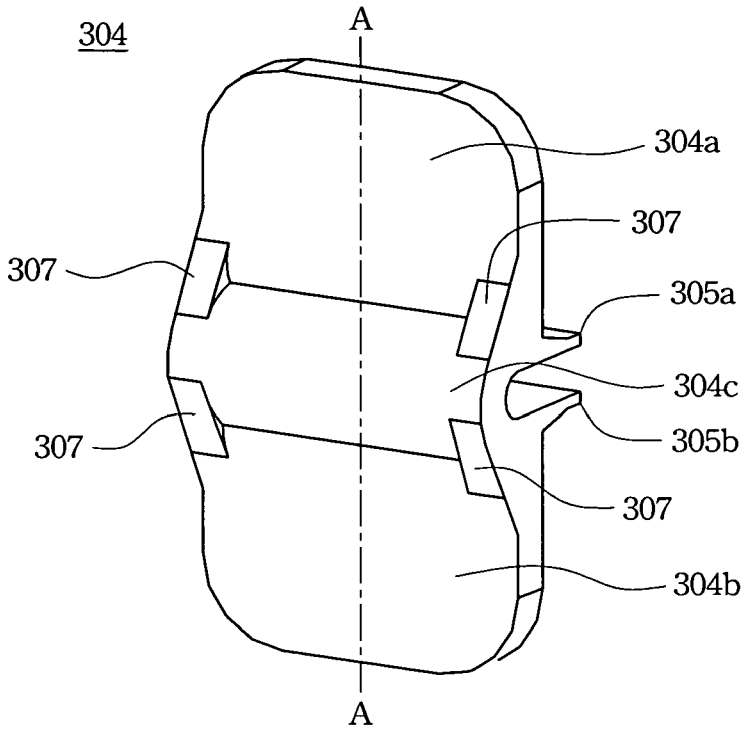
FIGS. 5A to 5B illustrate schematic diagrams of an cantilever with a rib according to the preferred embodiment of the present invention.
Figure 5B:
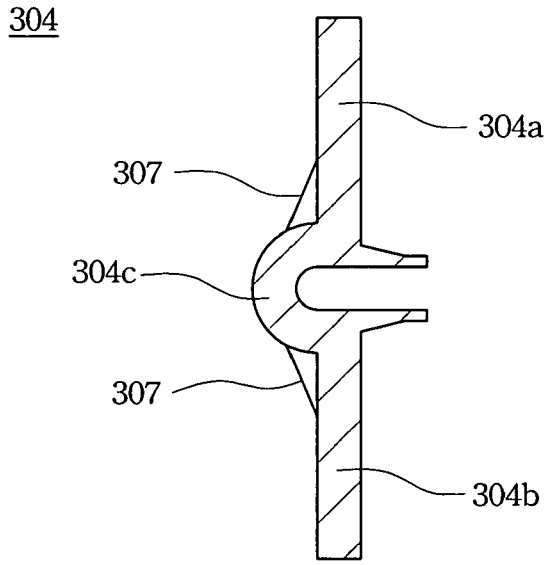

FIG. 5A is a three-dimensional diagram of a cantilever with ribs according to the preferred embodiment of the present invention, and FIG. 5B is a cross-sectional view along the A—A line of FIG. 5A. Referring to FIGS. 3C, 3D, 5A and 5B, additional ribs 307 are formed in the locations where the two connection parts 304*a* and 304*b* couple with the curved part 304*c* to enhance the mechanical strength of the cantilever 304.

Figure 6:
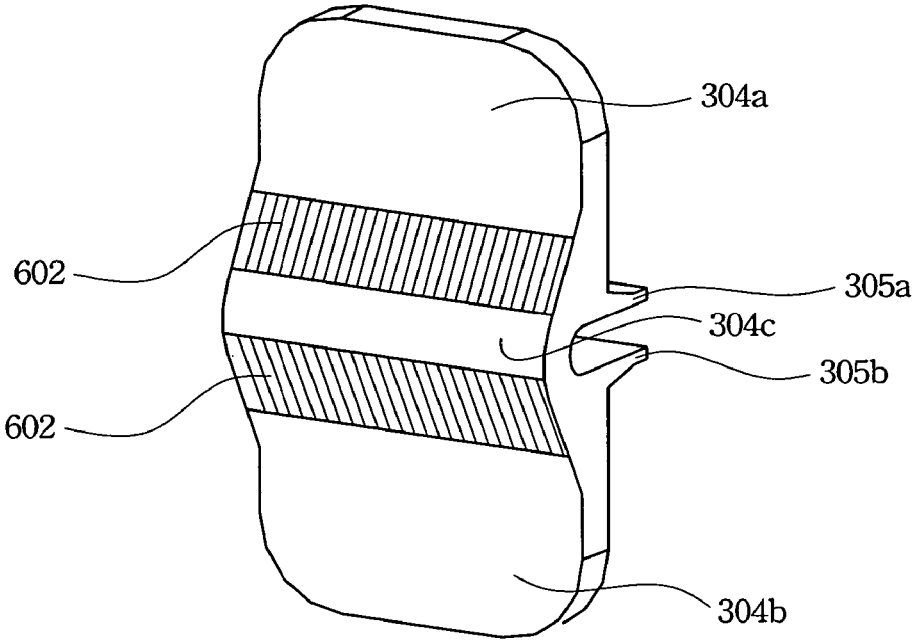
FIGS. 6 and 7 illustrate schematic diagrams of an cantilever with a rib according to the other embodiments of the present invention.
Figure 7:
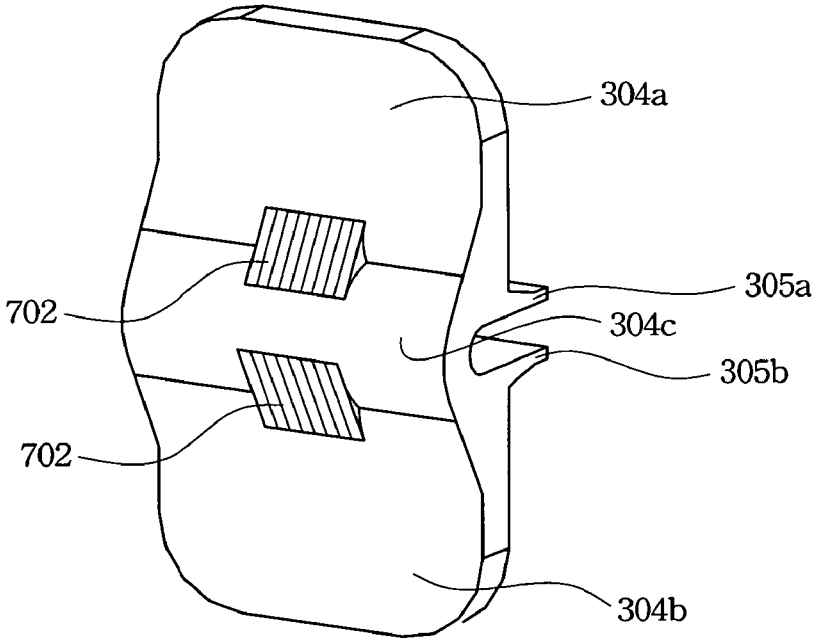

According to FIG. 5A, the ribs 307 are respectively formed in the two ends of the coupling locations of the two connection parts 304*a* and 304*b* coupled to the curved part 304*c*. However, in other embodiments, the ribs 602 are formed along the entire coupling location of the two connection parts as shown in FIG. 6. Alternatively, the ribs 702 are formed in the middle of the coupling location of the two connection parts as shown in FIG. 7. It is noticed that the ribs are changeable, as long as they are formed in one coupling location of the connection parts 304*a* or 304*b* coupled to the curved part 304*c*.

Accordingly, embodiment of the present invention provides a button structure including a cantilever connected to a housing and a key connected to the cantilever. This cantilever includes two connection parts and a curved part. The two connection parts are coupled together through the curved part. Since the cantilever has a curved part, the length of the cantilever can be shortened to make the key closer to the housing. Moreover, additional ribs are formed in the locations where the two connection parts couple to the curved part. Therefore, the mechanical strength of the locations is enhanced.

As is understood by a person skilled in the art, the foregoing descriptions of the preferred embodiment of the present invention are an illustration of the present invention rather than a limitation thereof. Various modifications and similar arrangements are included within the spirit and scope of the appended claims. The scope of the claims should be accorded to the broadest interpretation so as to encompass all such modifications and similar structures. While preferred embodiments of the invention have been illustrated and described, it will be appreciated that various changes can be made therein without departing from the spirit and scope of the invention.

What is claimed is:

1. A button structure located in a housing, comprising:

a key; and a cantilever, wherein the key and the housing are coupled together through the cantilever and comprise:

a first connection part coupling with the key;

a second connection part coupling with the housing;

a curved structure, wherein the first connection part and the second connection part are coupled together through the curved structure;

two ledges respectively extending from the location where the first connection part couples with the curved structure and the second connection part couples with the curved structure to connect with the key and the housing; and at least one rib formed in the location where the first connection part and the second connection part couple with the curved structure.

2. The button structure of claim 1, wherein the shape of the curved structure is a semicircle.

3. The button structure of claim 2, wherein the radius of the semicircle is about 0.3 mm to 0.6 mm.

4. A button structure located in a housing, comprising:

a key; and a cantilever structure extending from the housing and connecting with the key, wherein the cantilever comprises:

a first connection part coupling with the key;

a second connection part coupling wit the housing;

a curved structure, wherein the first connection part and the second connection part are coupled together trough the curved structure;

two ledges respectively extending from the location where the first connection part couples with the curved structure and and the second connection part couples with the curved structure to connect with the key and housing; and at least one rib formed in the location where the first connection part and the second connection part couple with the curved structure.

5. The cantilever structure of claim 4, wherein the shape of the curved structure is a semicircle.

6. The cantilever structure of claim 5, wherein the radius of the semicircle is about 0.3 mm to 0.6 mm.

* * * * *